United States Patent [19]

Kato et al.

[11] Patent Number: 4,923,790

[45] Date of Patent: May 8, 1990

[54] SILVER HALIDE PHOTOGRAPHIC MATERIAL

[75] Inventors: Hirohiko Kato; Keiji Mihayashi; Kazuhiro Aikawa, all of Kanagawa, Japan

[73] Assignee: Fuji Photo Film Co., Ltd., Kanagawa, Japan

[21] Appl. No.: 247,565

[22] Filed: Sep. 22, 1988

[30] Foreign Application Priority Data

Sep. 22, 1987 [JP] Japan ..... 62-23809

[51] Int. Cl.[5] ..... G03C 7/26; G03C 1/37

[52] U.S. Cl. ..... 430/523; 430/520; 430/531; 430/551; 430/564; 430/613; 430/614; 430/640; 430/644

[58] Field of Search ..... 430/531, 564, 640, 523, 430/520, 613, 644, 614, 557

[56] References Cited

U.S. PATENT DOCUMENTS

| | | | |
|---|---|---|---|
| 3,137,578 | 6/1964 | Selms | 430/614 |
| 3,255,202 | 6/1966 | Johnson | 430/614 |
| 3,325,506 | 6/1967 | Jones et al. | 548/127 |
| 3,336,192 | 8/1967 | Sarett et al. | 514/365 |
| 3,370,957 | 2/1968 | Wagner et al. | 426/9 |
| 3,471,508 | 10/1969 | Sarett et al. | 548/181 |
| 4,490,462 | 12/1984 | Kawaguchi et al. | 430/631 |

FOREIGN PATENT DOCUMENTS

| | | |
|---|---|---|
| 157244 | 9/1982 | Japan . |
| 190949 | 11/1982 | Japan . |
| 48892 | 10/1983 | Japan . |
| 263938 | 6/1984 | Japan . |
| 260951 | 12/1985 | Japan . |

*Primary Examiner*—Paul R. Michl
*Assistant Examiner*—Thorl Chea
*Attorney, Agent, or Firm*—Sughrue, Mion, Zinn, Macpeak & Seas

[57] ABSTRACT

A silver halide photographic material composed of a support having thereon at least one light-sensitive silver halide emulsion layer, wherein the material contains the combination of (i) at least one compound represented by formula (I) and (ii) and at least one compound represented by formulae (II) and/or (III):

(I)

wherein $R_1$ represents hydrogen, an alkyl group, an aryl group or an aralkyl group; X represents a halogen atom, a nitro group, a hydroxyl group, a cyano group, a lower alkyl group, a lower alkoxy group, $—COR_2$, or $—SO_3M$; $R_2$ represents hydrogen, —OM, a lower alkyl group, an aryl group, an aralkyl group, a lower alkoxy group, an aryloxy group, an aralkyloxy group or $R_3$ and $R_4$ each represents hydrogen, a lower alkyl group, an aryl group, an aralkyl group, $—COR_7$ or $—SO_2R_7$; $R_5$ and $R_6$ each represents hydrogen, a lower alkyl group, an aryl group or an aralkyl group; $R_7$ represents a lower alkyl group, an aryl group or an aralkyl group, M represents hydrogen, an alkali metal atom or atoms necessary for forming a monovalent cation, m represents 0 or an integer of 1 to 4, n represents 0 or an integer of 1 to 4, and Z represents an atomic group necessary for forming a thiazolyl ring;

(II)

where in $R_8$ represents a lower alkylene group, X is the same as X in formula (I), p represents 0 or 1, and q represents 0 or an integer of 1 to 5;

(III)

wherein $R_9$ represents hydrogen, an alkyl group, an alkenyl group, an aralkyl group, an aryl group, a heterocyclic group, $R_{10}$ and $R_{11}$ each represents hydrogen, an alkyl group, an aryl group, a cyano group, a heterocyclic group, an alkylthio group, an arylthio group, an alkylsulfonyloxy group or an alkylsulfonyl group; $R_{10}$ and $R_{11}$ may be linked to form an aromatic ring; and $R_{12}$ and $R_{13}$ each represents hydrogen, an alkyl group, an aryl group or an aralkyl group. The material has superior antifungal and antibacterial properties.

8 Claims, No Drawings

SILVER HALIDE PHOTOGRAPHIC MATERIAL

FIELD OF THE INVENTION

This invention relates to a silver halide photographic material and, more particularly, to a silver halide photographic material having improved image stability and improved stability in its preparation.

More particularly, it relates to a photographic light-sensitive material which provides a photographic image having improved antifungal and antibacterial properties.

BACKGROUND OF THE INVENTION

Many bactericides and antifungal agents used for killing bacteria and fungi are generally known, as described in, for example, *Biseibutsu no Mekkin, Sakkin, Bobai Gijutsu* ("Techniques of Sterilization, Pasteurization, and Fungicides of Microorganisms") compiled by Eisei Gijustu-kai ("Saninitary Technology Society") (published in 1982). In the field of silver halide photography, however, relatively few agents are known, and they have undesirable side effects such as reduction in photographic sensitivity. There are few agents which show satisfactory bactericidal and fungicidal effects when used in a small amount. For example, JP-A-60-263938 (The term "JP-A" as used herein means an "unexamined published Japanese Publication") discloses compounds effective as antifungal agent. JP-B-58-48892 (the term "JP-B" as used herein means an "examined Japanese Patent publication") discloses various compounds as antibacterial agents with some efficacy. However, these agents are still insufficient.

SUMMARY OF THE INVENTION

An object of the present invention is to provide a silver halide photographic material with sufficient antifungal and antibacterial properties, without adversely affecting the silver halide light-sensitive material or silver halide photographic image formed after development processing, and to prevent deterioration of photographic pictures caused by generation or growth of fungi and bacteria.

It has now been found that this and other objects of the present invention can be attained by a silver halide photographic material composed of a support having thereon at least one light-sensitive silver halide emulsion layer, wherein the material contains the combination of (i) at least one compound represented by formula (I) and (ii) at least one compound represented by formulae (II) and/or (III):

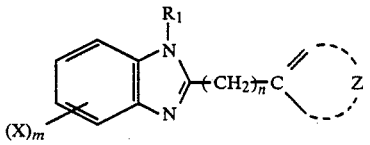

(I)

wherein $R_1$ represents hydrogen, a substituted or unsubstituted alkyl group, a substituted or unsubstituted aryl group or a substituted or unsubstituted aralkyl group, X represents a halogen atom, a nitro group, a hydroxyl group, a cyano group, a lower alkyl group, a lower alkoxy group $—COR_2$,

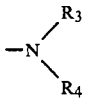

or $—SO_3M$; $R_2$ represents hydrogen, —OM, a lower alkyl group, an aryl group, an aralkyl group, a lower alkoxy group, an aryloxy group, an aralkyloxy group or

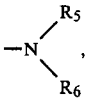

$R_3$ and $R_4$, which may be the same or different, each represents hydrogen, a lower alkyl group, an aryl group, an aralkyl group, $—COR_7$ or $—SO_2R_7$; $R_5$ and $R_6$, which may be the same or different, each represents hydrogen, a lower alkyl group, an aryl group or an aralkyl group; $R_7$ represents a lower alkyl group; an aryl group or an aralkyl group; M represents hydrogen, an alkali metal atom or a monovalent cation; m represents 0 or an integer of 1 to 4; n represents 0 or an integer of 1 to 4; and Z represents an atomic group necessary for forming a thiazolyl ring;

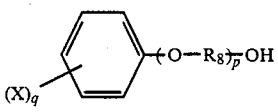

(II)

wherein $R_8$ represents a lower alkylene group; X is the same as X in formula (I); p represents 0 or 1, and q represents 0 or an integer of 1 or 5;

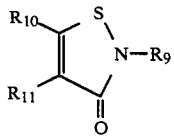

(III)

wherein $R_9$ represents hydrogen, a substituted or unsubstituted alkyl group, a substituted or unsubstituted alkenyl group, a substituted or unsubstituted aralkyl group, a substituted or unsubstituted aryl group, a heterocyclic group,

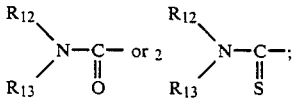

$R_{10}$ and $R_{11}$, which may be the same or different, each represents hydrogen, a substituted or unsubstituted alkyl group, a substituted or unsubstituted aryl group, a cyano group, a heterocyclic group, a substituted or unsubstituted alkylthio group, a substituted or unsubstituted arylthio group, a substituted or unsubstituted alkylsulfonyloxy group or a substituted or unsubstituted alkylsulfonyl group; $R_{10}$ and $R_{11}$ may be linked to form an aromatic ring; and $R_{12}$ and $R_{13}$, which may be the same or different, each represents hydrogen, a substituted or unsubstituted alkyl group, a substituted or unsubstituted aryl group or a substituted or unsubstituted aralkyl group.

DETAILED DESCRIPTION OF THE INVENTION

The compounds to be used in the present invention are described in greater detail below.

In the general formula (I), $R_1$ represents hydrogen, a substituted or unsubstituted alkyl group (for example, methyl, ethyl, 2-hydroxyethyl, 2-cyanoethyl, n-hexyl), a substituted or unsubstituted aryl group (for example, phenyl, p-chlorophenyl) or a substituted or unsubstituted aralkyl group (for example, benzyl, p-methoxybenzyl).

X represents a halogen atom (for example, chlorine, bromine, iodine), a nitro group, a hydroxyl group, a cyano group, a lower alkyl group (alkyl group containing 1 to 5 carbon atoms, for example, methyl, ethyl, butyl, t-butyl, t-pentyl), a lower alkoxy group (alkoxy group containing 1 to 5 carbon atoms, for example, methoxy, ethoxy, butoxy), $—COR_2$ (for example, carboxyl, acetyl, ethoxycarbonyl, butoxycarbonyl, carbamoyl,

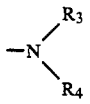

(for example, amino, dimethylamino, acetamido, methanesulfonamido) or $—SO_3M$ (for example, sulfo).

$R_1$ preferably represents hydrogen, X preferably represents an alkyl group containing 1 to 3 carbon atoms, an amino group, a nitro group, a sulfo group, a halogen atom or a hydroxy group, m preferably represents 1 or 2, n preferably represents 0, and the thiazole ring formed by Z preferably represents a 5-thiazolyl group.

Specific examples of the compounds represented by formula (I) are illustrated below, but the present invention is not to be construed as being limited thereto.

(I-1)

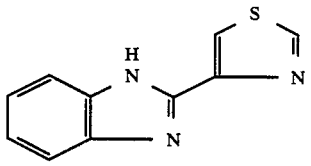

(I-2)

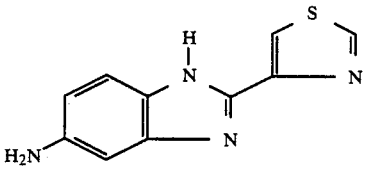

(I-3)

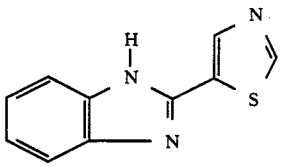

-continued (I-4)

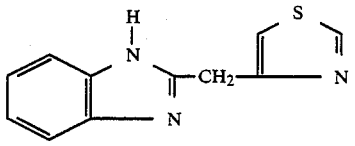

(I-5)

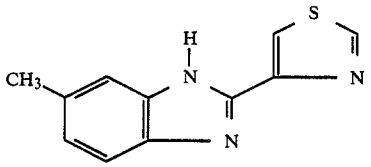

(I-6)

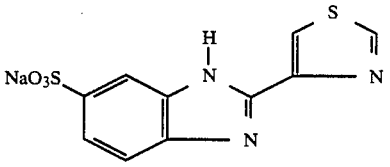

(I-7)

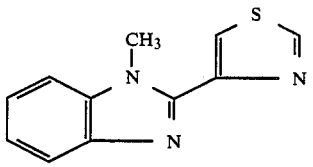

(I-8)

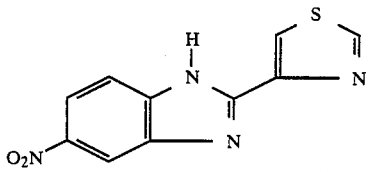

(I-9)

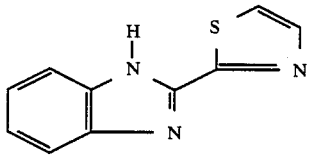

(I-10)

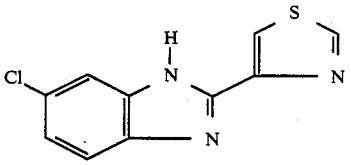

(I-11)

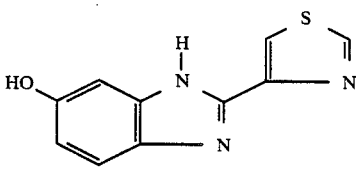

(I-12)

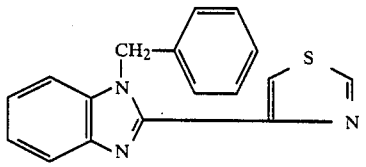

-continued (I-13)

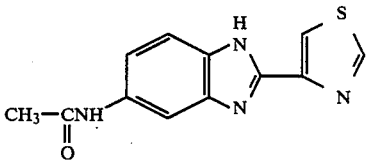

(I-14)

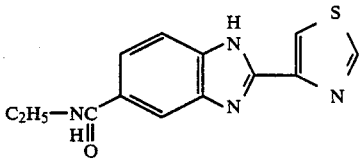

(I-15)

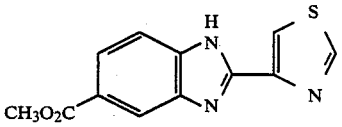

(I-16)

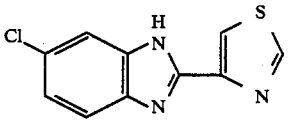

(I-17)

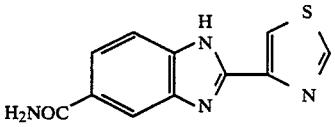

The compounds represented by formula (I) is disclosed, e.g., in JP-A-57-157244, JP-A-57-190949, JP-A-60-260951, and JP-A-60-263938.

In formula (II), $R_8$ represents an alkylene group (for example, methylene, ethylene, 1,3-propylene, 1,2-propylene, 1,4-butylene).

In formula (II), X preferably represents a lower alkyl group, an alkoxycarbonyl group or a halogen atom.

Specific examples of the compounds represented by formula (II) are illustrated below, the present invention is not to be construed as being limited thereto.

(II-1)

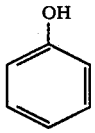

(II-2)

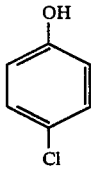

(II-3)

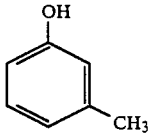

-continued (II-4)

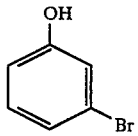

(II-5)

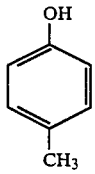

(II-6)

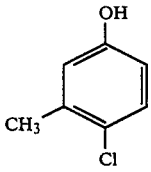

(II-7)

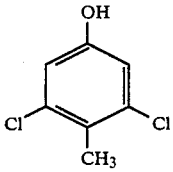

(II-8)

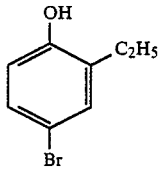

(II-9)

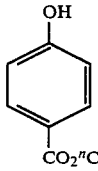

(II-10)

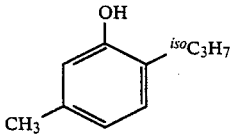

(II-11)

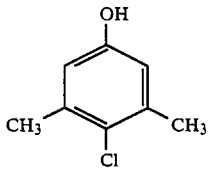

(II-12)

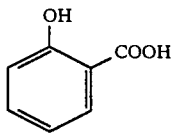

-continued
(II-13)
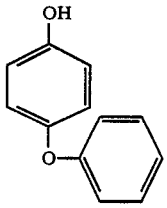
(II-14)
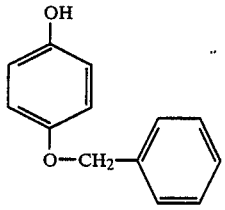
(II-15)
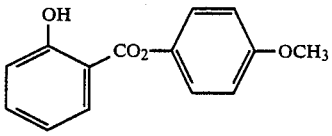
(II-16)
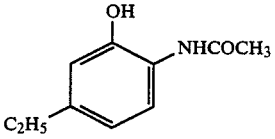
(II-17)
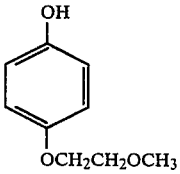
(II-18)
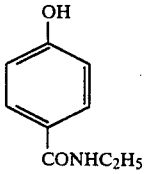
(II-18)
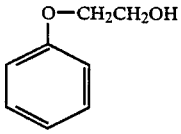
(II-19)
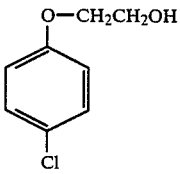
(II-20)
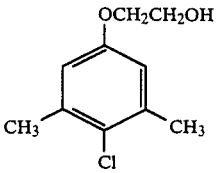
-continued
(II-21)
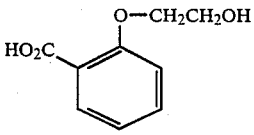
(II-22)
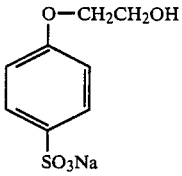
(II-23)
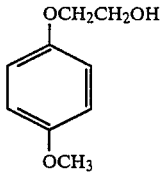
(II-24)
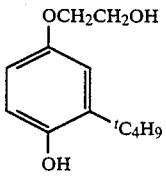
(II-25)
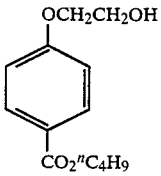
(II-26)
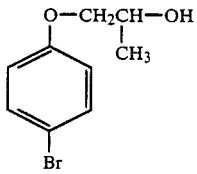
(II-27)
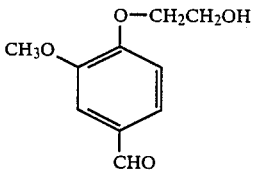
(II-28)
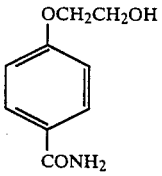
(II-29)
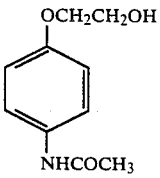

-continued (II-30)

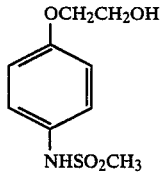

(II-31)

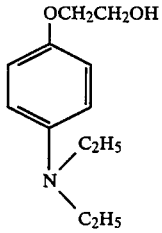

(II-32)

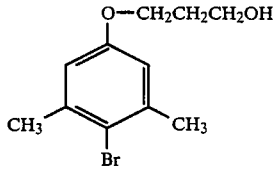

(II-33)

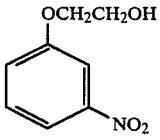

(II-34)

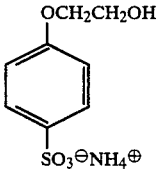

(II-35)

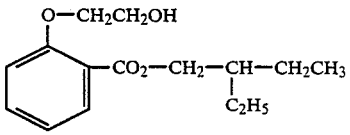

(II-36)

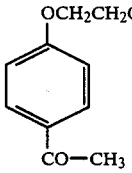

(II-37)

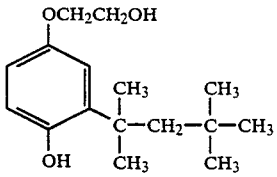

The compounds represented by formula (II) is a commercially available product.

In formula (III), $R_9$ represents a hydrogen, straight or branched chain, substituted or unsubstituted alkyl group (for example, methyl, ethyl, tert-butyl, n-octadecyl, 2-hydroxyethyl, 2-carboxyethyl, 2-cyanoethyl, sulfobutyl, N,N-dimethylaminoethyl), a substituted or unsubstituted cyclic alkyl group (for example, cyclohexyl, 3-methylcyclohexyl, 2-oxocyclopentyl), a substituted or unsubstituted alkenyl group (for example, allyl, methylallyl), a substituted or unsubstituted aralkyl group (for example, benzyl, p-methoxybenzyl, o-chlorobenzyl, p-iso-propylbenzyl), substituted or unsubstituted aryl group (for example, phenyl, naphthyl, o-methylphenyl, m-nitrophenyl, 3,4-dichlorophenyl), a heterocyclic group (for example, 2-imidazoly, 2-furyl, 2-thiazolyl, 2-pyridyl),

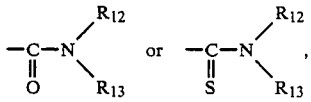

$R_{10}$ and $R_{11}$ each represents hydrogen, a substituted or unsubstituted alkyl group (for example, methyl, ethyl, chloromethyl, 2-hydroxyethyl, tert-butyl or n-octyl), a substituted or unsubstituted cyclic alkyl group (for example, cyclohexyl, 2-oxocyclopentyl), a substituted or unsubstituted aryl group (for example, phenyl, 2-methylphenyl, 3,4-dichlorophenyl, naphthyl, 4-nitrophenyl, 4-aminophenyl, 3-acetamidophenyl), a cyano group, a heterocyclic group (for example, 2-imidazolyl, 2-thiazolyl, 2-pyridyl), a substituted or unsubstituted alkylthio group (for example, methylthio, 2-cyanoethylthio, 2-ethoxycarbonylthio), a substituted or unsubstituted arylthio group (for example, phenylthio, 2-carboxyphenylthio, p-methoxyphenylthio), a substituted or unsubstituted alkylsulfonyloxy group (for example, methylsulfonyloxy or 2-hydroxyethylsulfonyloxy) or a substituted or unsubstituted alkylsulfonyl group (for example, methylsulfonyl, 2-bromoethylsulfonyl), with $R_{10}$ and $R_{11}$ being optionally linked to each other to form an aromatic ring (for example, benzene, naphthalene).

$R_{12}$ and $R_{13}$ each represents hydrogen, a substituted or unsubstituted alkyl group (for example, methyl, ethyl, iso-propyl, 2-cyanoethyl, 2-n-butoxycarbonylethyl, 2-cyanoethyl), a substituted or unsubstituted aryl group (for example, phenyl, naphthyl, 2-methoxyphenyl, m-nitrophenyl, 3,5-dichlorophenyl, 3-acetamidophenyl) or a substituted or unsubstituted aralkyl group (for example, benzyl, phenethyl, p-isopropylbenzyl, o-chlorobenzyl, m-methoxybenzyl).

$R_9$ preferably represents hydrogen, and an alkyl group, and $R_{10}$ and $R_{11}$ each preferably represents hydrogen, an alkyl group, an aryl group, and a cyano group.

Specific examples of the compounds represented by the general formula (III) are illustrated below, but the present invention is not to be construed as being limited thereto.

(III-1)

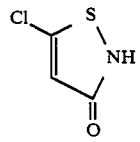

(III-2)

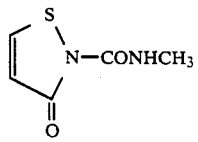

-continued
(III-3)
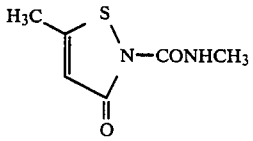
(III-4)
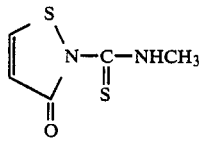
(III-5)
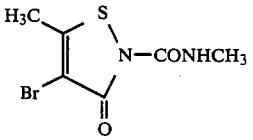
(III-6)
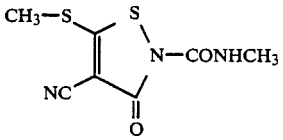
(III-7)
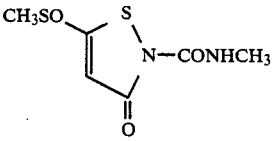
(III-8)
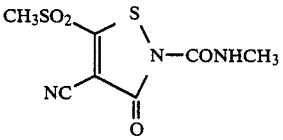
(III-9)
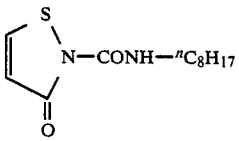
(III-10)
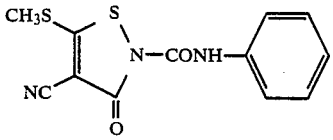
(III-11)
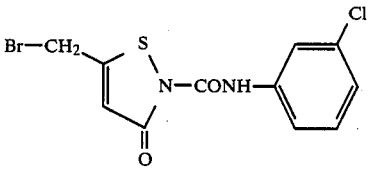
(III-12)
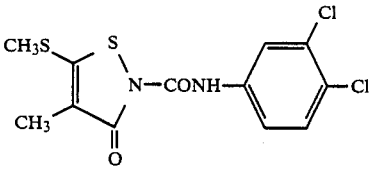
-continued
(III-13)
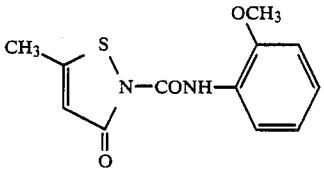
(III-14)
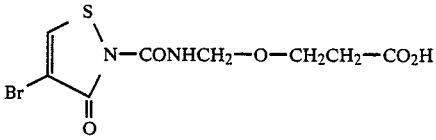
(III-15)
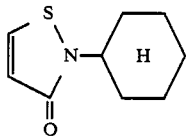
(III-16)
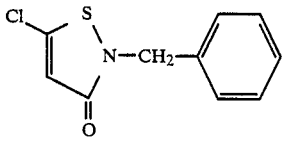
(III-17)
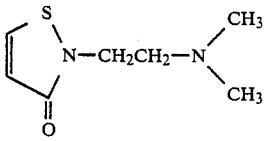
(III-18)
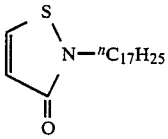
(III-19)
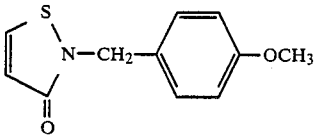
(III-20)
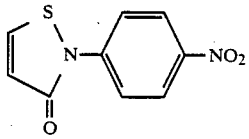
(III-21)
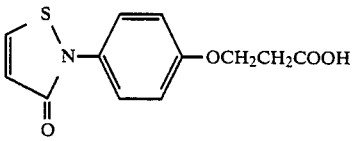
(III-22)
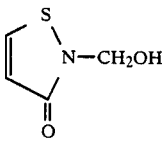

-continued
(III-23)
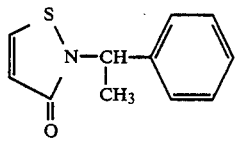
(III-24)
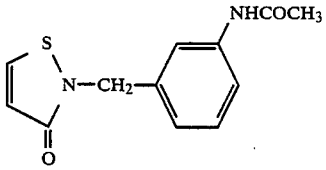
(III-25)
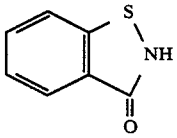
(III-26)
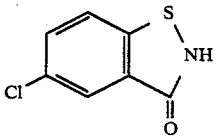
(III-27)
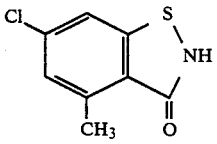
(III-28)
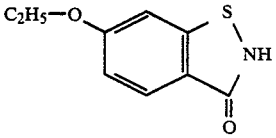
(III-29)
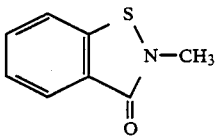
(III-30)
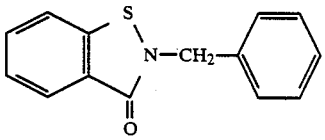
(III-31)
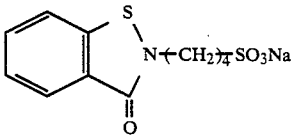
(III-32)
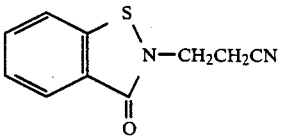
-continued
(III-33)
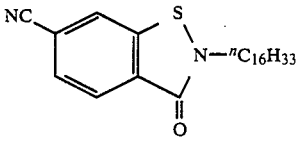
(III-34)
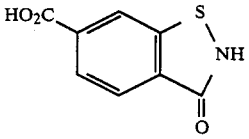
(III-35)
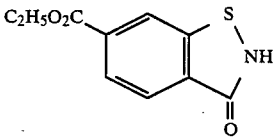
(III-36)
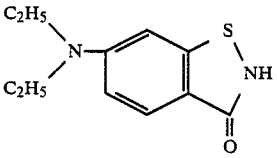
(III-37)
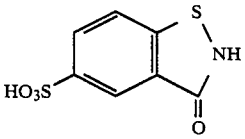
(III-38)
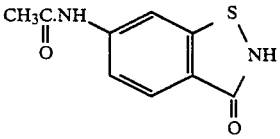
(III-39)
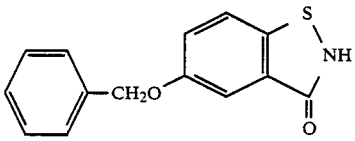
(III-40)
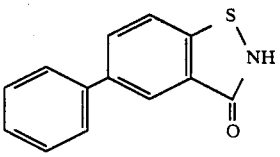
(III-41)
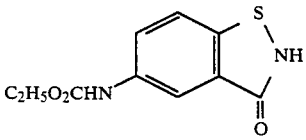
(III-42)
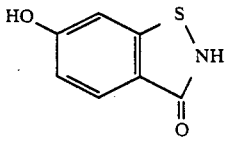

-continued

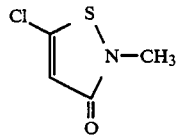

(III-43)

The compounds represented by formula (III) is disclosed, e.g., in U.S. Pat. No. 2,870,015 and French Pat. No. 1,555,416.

Of the above-described compounds, a combination of (I-1) and (II-1), a combination of (I-1) and (II-9), and a combination of (I-1) and (II-11) are particularly preferred.

The present invention can be applied to, for example, color negative films, color reversal films, color positive films, color papers, color reversal papers, black-and-white negative films, black-and-white papers, microfilms, lith films, X-ray films, color and black-and-white light-sensitive materials for diffusion transfer process, and silver dye-bleach type light-sensitive materials.

The antifungal and antibacterial effects can be obtained by adding the compounds represented by formulae (I), (II) and (III) to any one of, or more than one of, silver halide emulsion layers, gelatin interlayers and protective colloidal layers in these light-sensitive materials.

It is preferred that the compounds represented by formula (I) is added to a protective layer which is farthest from the support and the compounds represented by formulae (II) and (III) is added to a light-sensitive layer (e.g., a protective layer, an interlayer layer, an antihalation layer) or all photographic layer which constitutes a photographic material.

The compound represented by formula (I) is added in an amount of preferably 0.01 to 30 mg/m$^2$, particularly preferably 0.2 to 10 mg/m$^2$.

The compound represented by formula (II) is added in an amount of preferably 1 to 3000 mg/m$^2$, particularly preferably 50 to 1000 mg/m$^2$.

The compound represented by formula (III) is added in an amount of preferably 0.1 to 300 mg/m$^2$, particularly preferably 1 to 50 mg/m$^2$.

In incorporating the compounds represented by formulae (I), (II), and (III) in photographic light-sensitive materials, they are preferably added as a solution in an organic solvent such as methanol, ethanol, ethylene glycol, diethylene glycol, triethylene glycol, benzyl alcohol, ethanolamine, diethanolamine or triethanolamine, or in an emulsified state.

The combined use of the compound of the present invention represented by formula (I) and at least one compound selected from the compounds represented by formulae (II) and (III) is effective against all fungi growing in silver halide photographic images, but is particularly effective against the following fungi: *Aspergillus niger, Aspergillus gracilis, Aspergillus penicilloides, Pulluraria pullulanes, Chaetomium globosum, Cladosporium resinae, Aspergillus flavus, Aspergillus oryzac, Penicillium citrinum, Penicillium luteum, Trichoderma uiride, Aspergillus restrictus, Aspergillus glaucus,* Chrysosporium, *Aspergillus versirolor, Eurotium rubrum, Eurotium tonophilum,* and *Arthrium Pestalotia.*

The silver halide incorporated in the photographic emulsion layers of the photographic light-sensitive material of the present invention is silver chloride, silver bromide, silver iodide, silver iodobromide, silver iodochloride or silver iodochlorobromide.

The silver halide grains in the photographic emulsion may have a regular crystal form such as cubic, octahedral or tetradecahedral, an irregular form such as spherical or tabular, a form with crystal defects such as a twin plane, or a composite form thereof.

As to the grain size of silver halide grains, both fine grains of not larger than about 0.2 μm and large-sized grains of up to about 10 μm in projected area diameter may be used. The emulsion may be a polydispersed emulsion or a monodispersed emulsion.

The silver halide photographic emulsion used in the present invention may be prepared according to processes described in, for example, *Research Disclosure* (RD) No. 17643 (Dec., 1978), pp. 22–23, "I. Emulsion preparation and types" and ibid., No. 18716 (Nov., 1979), p. 648; Glafkides, *Chimie et Phisique Photographiique*, pages 329 to 425; (Paul Montel, 1967), G. F. Duffin, *Photographic Emulsion Chemistry*, pages 57 to 82 (Focal Press, 1966), V. L. Zelikman et al, *Making and Coating Photographic Emulsion* pages 69 to 87 (Focal Press, 1964), etc.

Monodispersed emulsions described in U.S. Pat. Nos. 3,574,628 and 3,655,394 and British Pat. No. 1,413,748, etc. are also preferred.

Tabular grains of about 5 or more in aspect ratio are also useful in the present invention. Such tabular grains may be easily prepared according to processes described in, for example, Gutoff, *Photographic Science and Engineering*, vol. 14, pp. 248–257 (1970), U.S. Pat. Nos. 4,434,226, 4,414,310, 4,433,048, 4,439,520 and British Pat. No. 2,112,157.

The crystal structure may be a uniform structure, a structure wherein the inner portion and the outer portion differ in halide composition, or a layered structure, or silver halide crystals different from each other may be joined to each other by epitaxial joined or, further, crystals conjuncted to other compounds than silver halide, such as silver rhodanide or lead oxide, may be used.

In addition, a mixture of grains of various crystal forms may also be used.

The silver halide emulsions are usually subjected to physical ripening, chemical ripening, and spectral sensitization before use. Additives to be used in these steps are described in *Research Disclosure* Nos. 17643 and 18716, as described in the following table.

Known photographic additives that can be used in the present invention are also described in the above-described two *Research Disclosures* as summarized in the following table.

| Kind of Additive | RD 17643 | RD 18716 |
|---|---|---|
| 1. Chemical sensitizer | p. 23 | p. 648, right col. |
| 2. Sensitivity-raising agent | | " |
| 3. Spectrally sensitizing agent and Supersensitizing agent | pp. 23–24 | p.648, right col. to p. 649, right col. |
| 4. Whitening agent | p. 24 | |
| 5. Antifoggant and Stabilizer | pp. 24–25 | p. 649, right col. |
| 6. Light-absorbing agent, Filter dye, and UV ray absorbent | pp. 25–26 | p. 649, right col. to p. 650, left col. |
| 7. Stain-preventing agent | p. 25, right col. | p. 650, left to right col. |
| 8. Dye image stabilizer | p. 25 | |
| 9. Hardener | p. 26 | p. 651, left col. |
| 10. Binder | p. 26 | p. 651, left col. |
| 11. Plasticier and Lubricant | p. 27 | p. 650, right col. |

-continued

| Kind of Additive | RD 17643 | RD 18716 |
|---|---|---|
| 12. Coating aid and Surfactant | pp. 26–27 | " |
| 13. Antistatic agent | p. 27 | " |

Various color couplers may be used in the present invention, and specific examples thereof are described in the patents disclosed in the foregoing *Research Disclosure* (RD), No. 17643, VII-C to G.

As yellow couplers, those described in, for example, U.S. Pat. Nos. 3,933,501, 4,022,620, 4,326,024 and 4,401,752, JP-B-58-10739, British Pat. Nos. 1,425,020 and 1,476,760 are preferred.

As magenta couplers, 5-pyrazolone type and pyrazoloazole type compounds are preferred including those described in, for example, U.S. Pat. Nos. 4,310,619, 4,351,897, European Pat. No. 73,636, U.S. Pat. Nos. 3,061,432 and 3,725,067, *Research Disclosure*, No. 244220 (Jun., 1984), JP-A-60-33552, *Research Disclosure*, No. 24230 (Jun., 1984), JP-A-60-43659, U.S. Pat. Nos. 4,500,630 and 4,540,654.

As cyan couplers, there are illustrated phenolic and naphtholic couplers, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German patent application (OLS) No. 3,329,729, European Pat. No. 121,365A, U.S. Pat. Nos. 3,446,622, 4,333,999, 4,451,559, 4,427,767, and European Pat. No. 161,626A, etc. are preferable.

As colored couplers for correcting unnecessary absorption of colored dyes, those described in *Research Disclosure*, No. 17643, Item VII-G, U.S. Pat. No. 4,163,670, JP-B-57-39413, U.S. Pat. Nos. 4,004,929, 4,138,258, and British Pat. No. 1,146,368 are preferred.

As couplers capable of forming colored dyes with a suitable diffusibility, those described in U.S. Pat. No. 4,366,237, British Pat. No. 2,125,570, European Pat. No. 96,570, and West German patent application (OLS) No. 3,234,533 are preferred.

Typical examples of polymerized dye-forming couplers are described in U.S. Pat. Nos. 3,451,820, 4,080,211, and 4,367,282, British Pat. No. 2,102,173, etc.

Couplers capable of releasing a photographically useful residue upon coupling reaction are also preferably used in the present invention. As DIR couplers capable of releasing a development inhibitor, those described in the patents mentioned in the foregoing RD 17643, Item VII-F, JP-A-57-151944, JP-A-57-154234, JP-A-60-184248, and U.S. Pat. No. 4,248,962 are preferred.

As couplers capable of imagewise releasing a nucleating agent or a development accelerator upon development, those described in British Pat. Nos. 2,097,140 and 2,131,188, JP-A-59-157638 and JP-A-59-170840 are preferred.

Further couplers to be used in the light-sensitive material of the present invention include, for example, competitive couplers described in U.S. Pat. No. 4,130,427, etc.; polyequivalent couplers described in U.S. Pat. Nos. 4,283,472, 4,338,393, 4,310,618, etc.; DIR redox compound-releasing couplers described in JP-A-60-185950, etc.; and couplers capable of re-acquiring color after being released which are described in European Pat. No. 173,302A.

The couplers to be used in the present invention may be introduced into light-sensitive materials by various known dispersing processes.

Examples of high-boiling point organic solvents to be used in the oil-in-water dispersion process are described in, for example, U.S. Pat. No. 2,322,027.

Steps and advantages of the latex dispersion process and specific examples of latexes for impregnation are described in U.S. Pat. No. 4,199,363, West German patent application (OLS) Nos. 2,541,274 and 2,541,230.

Suitable supports to be used in the present invention are described in, for example, the above-mentioned RD, No. 17643, p. 28 and ibid., No. 18716, p. 647, right to column to p. 648, left column.

The color photographic material of the present invention may be development processed according to common processes described in the foregoing RD, No. 17643, pp. 28–29 and ibid., No. 18716, p. 651, left column to right column.

The color developer to be used for development processing light-sensitive materials of the present invention is preferably an alkaline aqueous solution containing an aromatic primary amine color developing agent as a major component. As the color developing agents, p-phenylenediamine compounds are preferably used, though aminophenol compounds are also useful. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides or p-toluenesulfonates thereof. These compounds may be used as a combination of two or more depending upon the purpose.

The color developer generally contains a pH buffer agent such as an alkali metal carbonate, borate or phosphate, a development inhibitor or antifoggant such as a bromide, an iodide, a benzimidazole, a benzothiazole or a mercapto compound. If necessary, various preservatives such as hydroxylamine, diethylhydroxylamine, hydrazine sulfites, phenylsemicarbazides, triethanolamine, catecholsulfonic acids, triethylenediamine (1,4-diazabicyclo(2,2,2)octane), etc.; organic solvents such as ethylene glycol, diethylene glycol, etc.; development accelerators such as benzyl alcohol, polyethylene glycol, quaternary ammonium salts, amines, etc.; dye-forming couplers; competitive couplers; fogging agents such as sodium borohydride; auxiliary developing agents such as 1-phenyl-3-pyrazolidone; viscosity-imparting agents; various chelating agents represented by aminopolycarboxylic acids, aminopolyphosphonic acid, alkylphosphonic acids, and phosphonocarboxylic acids such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N'N'-tetramethylenephosphonic acid, ethylenediamine-di(o-hydroxyphenylacetic acid) and salts thereof, may be added to the color developer.

In conducting reversal processing, usually black-and-white development is conducted before color development. This black-and-white developer includes known black-and-white developing agents such as dihydroxybenzenes (for example, hydroquinone), 3-pyrazolidones (for example, 1-phenyl-3-pyrazolidone) and aminophenols (for example, N-methyl-p-aminophenol) alone or as a combination thereof.

These color developer and black-and-white developer generally have a pH of 9 to 12. These developers are replenished generally in amounts of up to 3 liters per $m^2$ of light-sensitive materials, though depending upon the kind of color photographic light-sensitive materials to be processed. The replenishing amount may be reduced to not more than 500 ml by decreasing the bromide ion concentration in the replenisher. In the case of decreasing the replenishing amount, contact area between the solution and the air within the processing tank be preferably minimized to thereby prevent vaporization and air oxidation of the solution. In addition, the replenishing amount may also be decreased by employing means of depressing accumulation of bromide ion in the developer.

Color-developed photographic emulsion layers are usually bleached. Bleaching may be conducted independently or simultaneously with fixing (bleach-fixing). In order to promote the processing, bleach-fixing may be conducted after bleaching. Further, it is possible to use two continuous bleach-fixing baths, to fix before bleach-fixing or to bleach-fix after bleach-fixing, as desired. As the bleaching agent, compounds of polyvalent metals such as iron(III), cobalt(III), chromium (VI), copper(II), etc., peracids, quinones, nitro compounds, and the like are used. As typical bleaching agents, ferricyanides; dichromates; organic complex salts of iron(III) or cobalt(III), for example, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid or of organic acids such as citric acid, tartaric acid and malic acid; persulfates; bromide acid salts; permanganates; nitrobenzenes; etc. may be used. Of these, iron (III) aminopolycarboxylates including iron (III) ethylenediaminetetraacetate and persulfates are preferred in view of rapid processing and prevention of environmental pollution. Further, iron (III) aminopolycarboxylate complex salts are particularly useful in both an independent bleaching solution and a bleach-fixing solution.

The bleaching or bleach-fixing solution containing these iron(III) aminopolycarboxylate complex salts usually has a pH of 5.5 to 8, but may have a lower pH for accelerating the processing.

A bleach accelerator may be used in the bleaching solution, bleach-fixing solution, or pre-baths thereof. As specific examples of useful bleach accelerators, there are illustrated mercapto group- or disulfido group-containing compounds described in, for example, U.S. Pat. No. 3,893,858, West German Pat. Nos. 1,290,812 and 2,059,988, JP-A-53-32736, JP-A-53-57831, JP-A-53-37418, JP-A-53-72623, JP-A-53-95630, JP-A-53-95631, JP-A-53-10423, JP-A-53-124424, JP-A-53-141623, JP-A-53-28426, and *Research Disclosure*, No. 17129 (Jul., 1978); thiazolidine derivatives described in JP-A-50-140129; thiourea derivatives described in JP-B-45-8506, JP-A-52-20832, JP-A-53-32735, U.S. Pat. No. 3,706,561, etc.; iodides described in West German Pat. No. 1,127,715, and JP-A-58-16235; polyoxyethylenes described in West German Pat. Nos. 966,410 and 2,748,430; polyamines described in JP-B-45-8836; compounds described in JP-A-49-42434, JP-A-49-59644, JP-A-53-94927, JP-A-54-35727, JP-A-55-26506, JP-A-58-163940; and bromide ion. Of these, mercapto group- or disulfido group-containing compounds are preferable due to their great accelerating effect, and compounds described in U.S. Pat. No. 3,893,858, West German Pat. No. 1,290,812 and JP-A-53-95630 are particularly preferred. In addition, those compounds which are described in U.S. Pat. No. 4,552,834 are also preferred. These beach accelerators may be incorporated into the photographic materials.

These bleach accelerators are particularly effective in bleach-fixing color light-sensitive materials for photographing use.

Fixing agents include, for example, thiosulfates, thiocyanates, thioether compounds, thioureas and a large amount of an iodide salt. Of these, thiosulfates are generally used, with ammonium thiosulfate being most widely used. As preservatives for the bleach-fixing solution, sulfites, bisulfites or carbonyl-bisulfite adducts are preferred.

After removal of silver, the silver halide color photographic material of the present invention is generally subjected to a water-washing step and/or stabilizing step. The amount of water used in the water-washing step may be selected in a wide range depending upon the characteristics of the light-sensitive material (resulting from, for example, materials such as couplers), end-use, temperature of the washing water, number (step number) of washing tanks, manner of replenishment (countercurrent manner or direct current manner), and other various conditions. Of these, the number of water-washing tanks and the amount of washing water can be determined according to the method described in *Journal of the Society of Motion Picture and Television Engineers* vol. 64, pp. 248–253 (May, 1955).

The multistage countercurrent manner described in the above-described publication permits to marked reduction of the amount of washing water but since the standing time of water within the tanks is prolonged, there arises a problem of adhesion of floating matter produced as a result of growth of bacteria. In order to solve the problem in processing the color light-sensitive material of the present invention, the technique of reducing the level of calcium ion and magnesium ion described in JP-A-62-288838 may be effectively employed. In addition, chlorine-containing bactericides (for example, sodium chloroisocyanurate and bactericides described in *Bokin Bobai no Kagaku* ("Chemistry of bactericides and fungicides") written by Hiroshi Horiguchi, *Biseibutsu no Mekkin, Sakkin, Bobai Gijutsu* ("Techniques of Sterilization, Pasteurization, and Fungicides of Microorganisms") compiled by Eisei Gijustukai ("Sanitary Technology society") and *Bokin Bobaizai Jiten* ("Book of Bactericides and Fungicides") compiled by Nippon Bokin Bobai Gakkai ("Japan Bactericide and Fungicide Society"), such as benzotriazoles may be used.

The washing water to be used for processing the light-sensitive material of the present invention has a pH of 4 to 9, preferably 5 to 8. The washing temperature and washing time may be variously selected depending upon the characteristics and end-use of light-sensitive materials, but, as a general guide, a washing temperature of 15° to 45° C. and a washing time of 20 seconds to 10 minutes is typical, with a washing temperature of 25° to 40° C. and a washing time of 30 seconds to 5 minutes being preferred. Further, the light-sensitive material of the present invention may be directly processed with a stabilizing solution in place of the above-described washing with water. In such stabilizing processing, all known techniques described in JP-A-57-8543, JP-A-58-14834 and JP-A-60-220345 may be employed.

In addition, stabilizing processing may be conducted subsequent to the above-described water-washing processing. For example, a stabilizing bath containing formalin and a surfactant can be used as a final bath for processing color light-sensitive materials for photographic use. To this stabilizing bath may also be added various chelating agents and antifungal agents.

An over-flow solution produced as a result of replenishment of the washing water and/or stabilizing solution may be re-used in other steps such as silver-removing step.

Color developing agents may be incorporated in the silver halide color photographic material of the present invention for the purpose of simplifying and accelerating the processing. Various precursors of the color developing agents to be incorporated are preferably used. For example, These include indoaniline compounds described in U.S. Pat. No. 3,342,597; Schiff base type compounds described in U.S. Pat. No. 3,342,599 and *Research Disclosure* Nos. 14,850 and 15,159; aldol compounds described in *Research Disclosure* No. 13,924; metal salt complexes described in U.S. Pat. No. 3,719,492; and urethane compounds described in JP-A-53-135628.

The silver halide color photographic material of the present invention may contain, if necessary, various 1-phenyl-3-pyrazolidones for the purpose of accelerating color development. Typical examples thereof are described in, for example, JP-A-56-64339, JP-A-57-144547 and JP-A-58-115438.

Various processing solutions in the present invention are used at temperatures of 10° C. to 50° C. Temperatures of 33° C. to 38° C. are standard, but higher temperatures may be employed for accelerating processing and shortening processing time, or lower temperature may be employed to improve image quality or stability of processing solutions. In addition, processing using cobalt intensification or hydrogen peroxide intensification described in West German Pat. No. 2,226,770 or U.S. Pat. No. 3,674,499 may be conducted for saving silver of light-sensitive materials.

Growth of fungi and bacteria can be markedly prevented by incorporation of the compound represented by the general formula (I) and the compound represented by the general formula (II) and/or (III) in photographic light-sensitive materials. This effect is suprisingly greater than that obtained by independently using the compounds of the general formulae (I), (II) and (III).

The present invention is now illustrated in more detail with reference to the following examples which, however, are not to be construed as limiting the scope of the present invention in any way. Unless otherwise indicated, all parts, percents and ratios are by weight.

EXAMPLE 1

A color light-sensitive material composed of a subbed cellulose triacetate film support having provided thereon the layers of the following formulations, referred to as Sample 101, was prepared.

Formulation of light-sensitive layer:

Coated amounts are in terms of g/m$^2$ of silver with respect to silver halide and colloidal silver, g/m$^2$ with respect to couplers, additives, and gelatin, and mol per mol of silver halide in the same layer with respect to sensitizing dyes.

| | |
|---|---|
| 1st layer (Antihalation layer) | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| 2nd layer (Interlayer) | |
| Fine-grain silver bromide (average grain size: 0.07μ) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| 3rd layer (First red-sensitive emulsion layer) | |
| AgBrI emulsion (AgI: 2 mol %; AgI content in the inner portion being higher than that in the outer portion; sphere-corresponding diameter: 0.3μ; variation coefficient of sphere-corresponding diameter: 29%; mixture of regular crystals and twin crystals; diamter/thickness ratio: 2.5) | 0.4 |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| Exc-2 | 0.03 |
| Solv-1 | 0.03 |
| Solv-3 | 0.012 |
| 4th layer (Second red-sensitive emulsion layer) | |
| AgBrI emulsion (AgI: 5 mol %; AgI content in the inner portion being higher than that in the outer portion; sphere-corresponding diameter: 0.7μ; variation coefficient: 25%; mixture of regular crystals and twin crystals; diameter/thickness ratio: 4) | 0.7 |
| Gelatin | 0.5 |
| ExS-1 | $1 \times 10^{-4}$ |
| ExS-2 | $3 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |
| 5th layer (Third red-sensitive emulsion layer) | |
| AgBrI emulsion (AgI: 10 mol %; AgI content in the inner portion being higher than that in the outer portion; sphere-corresponding diameter: 0.8μ; variation coefficient: 16%; mixture of regular crystals and twin crystals; diameter/thickness ratio: 1.3) | 1.0 |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.1 |
| Solv-1 | 0.01 |
| Solv-2 | 0.05 |
| 6th layer (Interlayer) | |
| Gelatin | 1.0 |
| Cpd-1 | 0.03 |
| Solv-1 | 0.05 |
| 7th layer (First green-sensitive emulsion layer) | |
| AgBrI emulsion (AgI: 2 mol %; AgI content in the inner portion being higher than that in the outer portion; sphere-corresponding diameter: 0.3μ; variation coefficient of sphere-corresponding | 0.30 |

-continued

| | |
|---|---|
| diameter: 28%; mixture of regular crystals and twin crystals: diameter/ thickness ratio: 2.5) | |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| 8th layer (Second green-sensitive emulsion layer) | |
| AgBrI emulsion (AgI: 4 mol %; AgI content in the inner portion being higher than that in the outer portion; sphere-corresponding diameter: 0.6μ; variation coefficient of sphere-corresponding diameter: 38%; mixture of regular crystals and twin crystals: diameter/ thickness ratio: 4) | 0.4 |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.01 |
| 9th layer (Third green-sensitive emulsion layer) | |
| AgBrI emulsion (AgI: 6 mol %; AgI content in the inner portion being higher than that in the outer portion; sphere-corresponding diameter: 1.0μ; variation coefficient of sphere-corresponding diameter: 80%, mixture of regular crystals and twin crystals; diameter/ thickness ratio: 1.2) | 0.85 |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| 10th layer (Yellow filter layer) | |
| Gelation | 1.2 |
| Yellow colloidal silver | 0.08 |

-continued

| | |
|---|---|
| Cpd-2 | 0.1 |
| Solv-1 | 0.3 |
| 11th layer (First blue-sensitive emulsion layer) | |
| AgBrI emulsion (AgI: 4 mol %; AgI content in the inner portion being higher than that in the outer portion; sphere-corresponding diameter: 0.5μ; variation coefficient of sphere-corresponding diameter: 15%; octahedral grains) | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |
| 12th layer (second blue-sensitive emulsion layer) | |
| AgBrI emulsion (AgI: 10 mol %; AgI content in the inner portion being higher than that in the outer portion; sphere-corresponding diameter: 1.3μ; variation coefficient of sphere-corresponding diameter: 25%; mixture of regular crystals and twin crystals; diameter/ thickness ratio: 4.5) | 0.5 |
| Gelatin | 0.6 |
| ExS-9 | $1 \times 10^{-4}$ |
| ExY-16 | 0.25 |
| Solv-1 | 0.07 |
| 13th layer (First protective layer) | |
| Gelatin | 0.8 |
| UV-1 | 0.1 |
| UV-2 | 0.2 |
| Solv-1 | 0.01 |
| Solv-2 | 0.01 |
| 14th layer (Second protective layer) | |
| Fine-grain AgBr (average grain size: 0.07μ) | 0.5 |
| Gelatin | 0.45 |
| Polymethyl methacrylate particles (diameter: 1.5μ) | 0.2 |
| H-1 | 0.4 |
| Cpd-3 | 0.5 |
| Cpd-4 | 0.5 |

In addition to the above-described ingredients, a surfactant H-1 was added to each layer as a coating aid. The thus prepared sample was referred to as Sample 101.

The chemical structural formulae or chemical names of the compounds used in this Example are shown below.

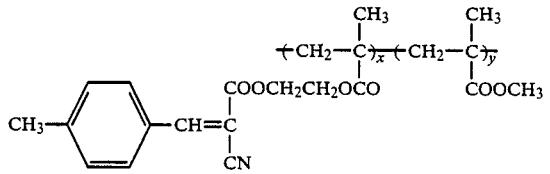

UV-1 x/y = 7/3 (weight ratio)

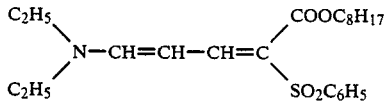

UV-2

| | |
|---|---|
| Tricresyl phosphate | Solv-1 |
| Dibutyl phthalate | Solv-2 |
| Bis(2-ethylhexyl)phthalate | Solv-3 |

-continued
ExM-8
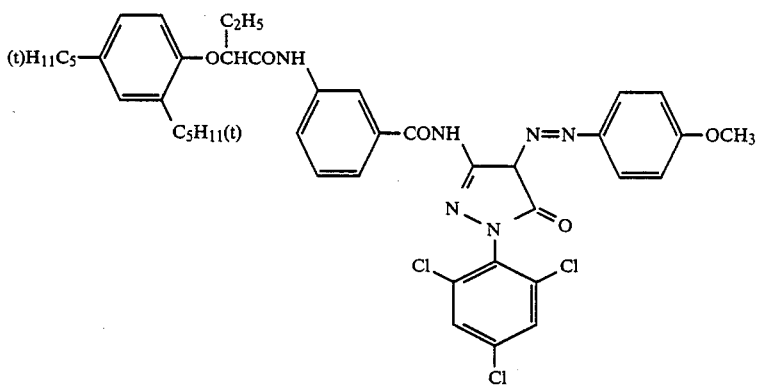
ExF-1
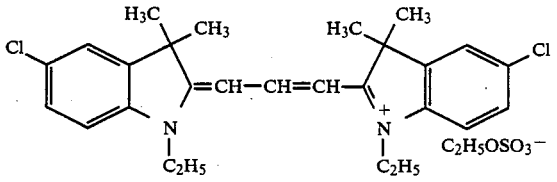
ExC-2
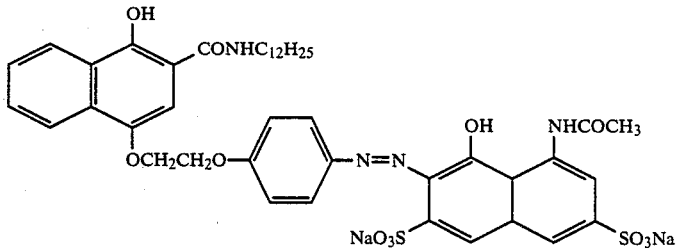
ExC-3
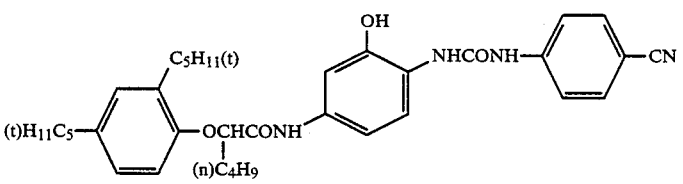
ExC-4
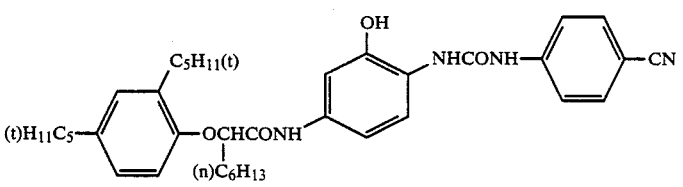
ExY-14
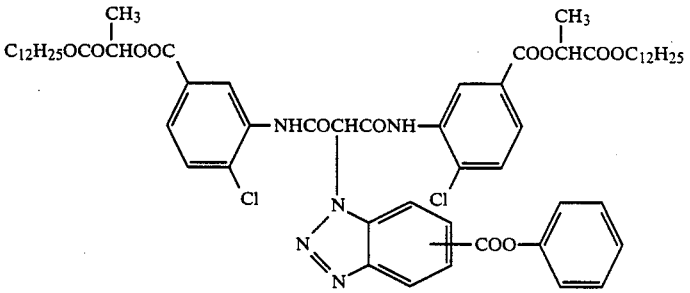
(the phenoxycarbonyl group is bonded to 5- or 6- position of the benzotriazole)

-continued
ExY-15
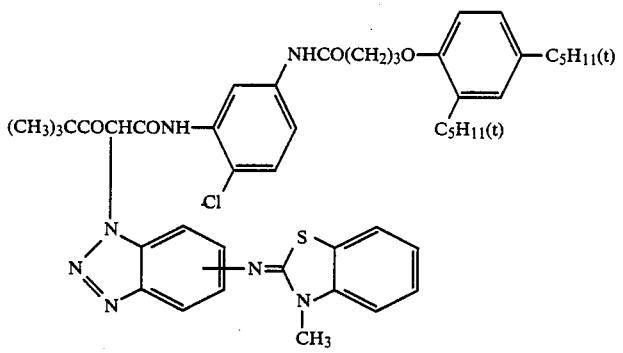
(the phenoxycarbonyl group is bonded to 5- or 6- position of the benzotriazole)
ExC-5
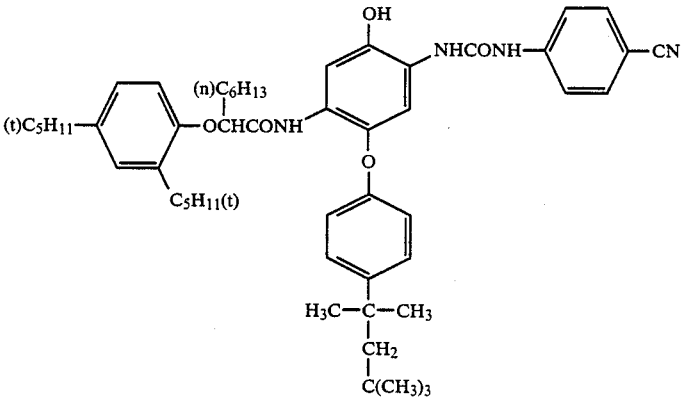
ExC-6
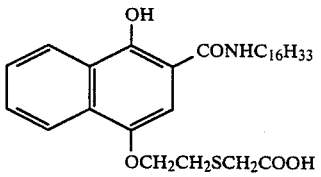
ExC-7
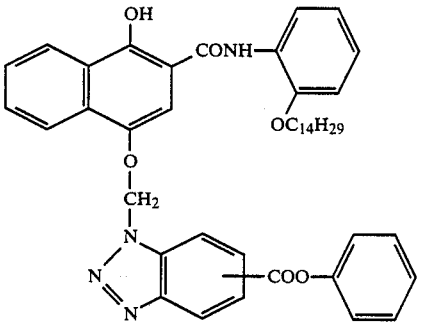

-continued
ExM-9
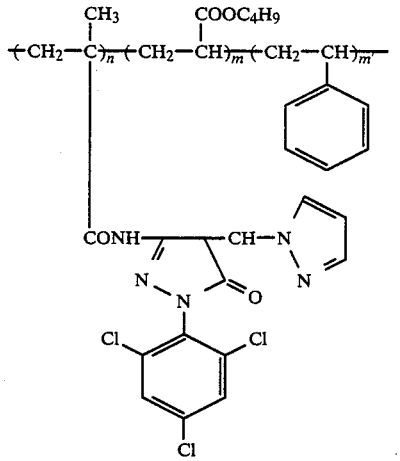
n = 50
m = 25
m' = 25
mol. wt. ca. 20,000
ExM-10
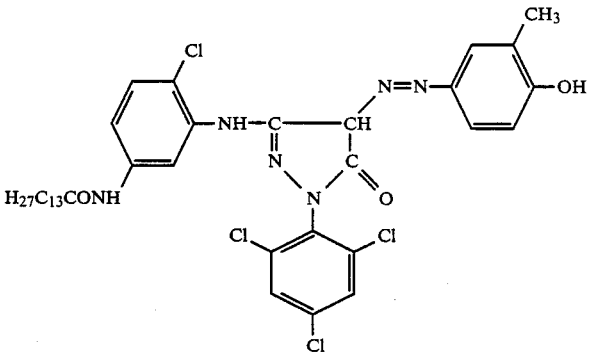
ExM-11
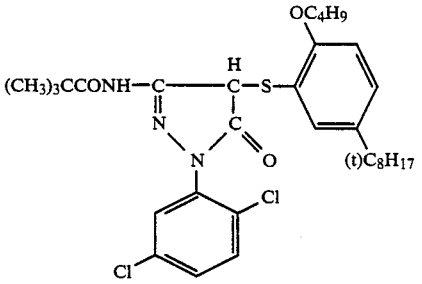
ExM-12
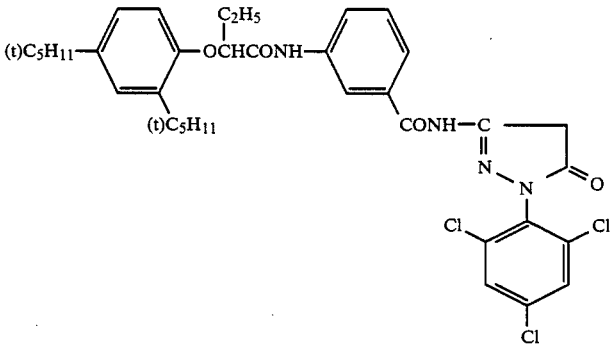

-continued
ExM-13
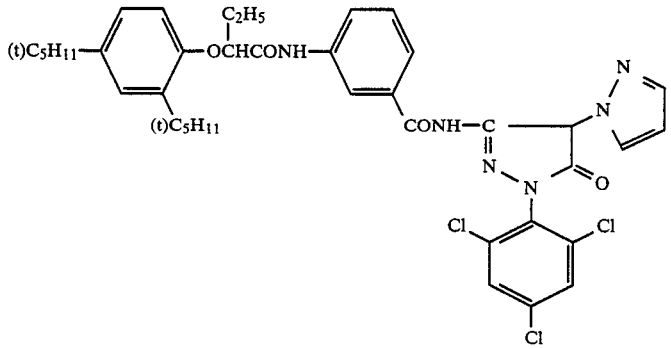
ExY-16
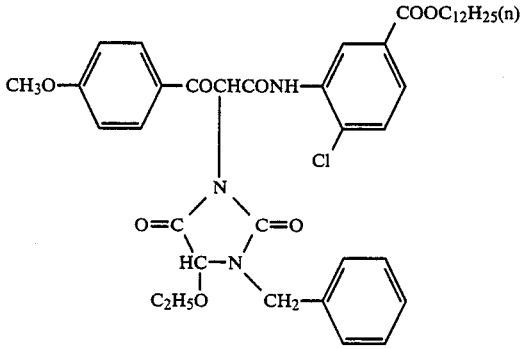
Cpd-1
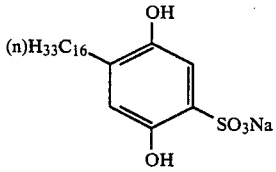
Cpd-2
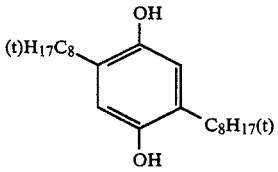
ExS-1
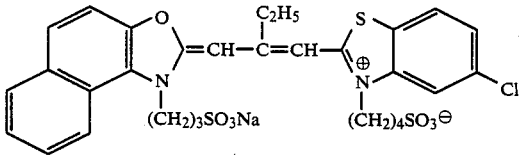
ExS-2
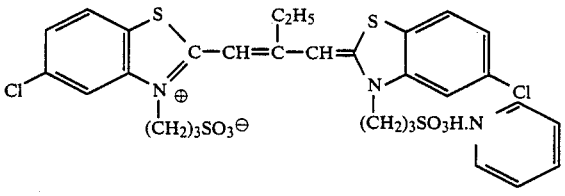
ExS-3
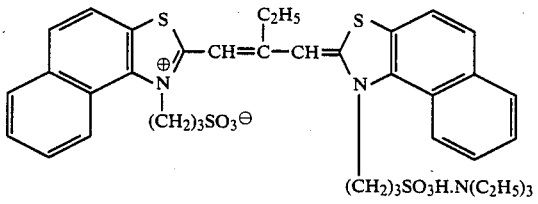

-continued
ExS-4
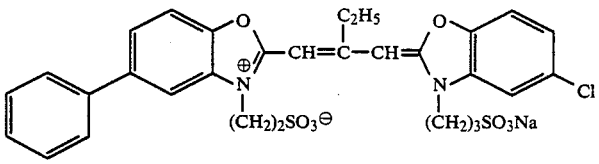
ExS-5
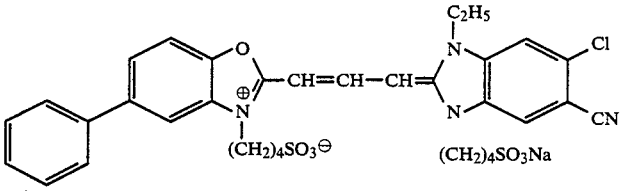
ExS-6
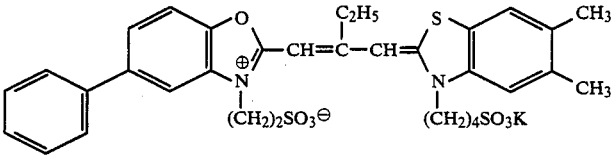
ExS-7
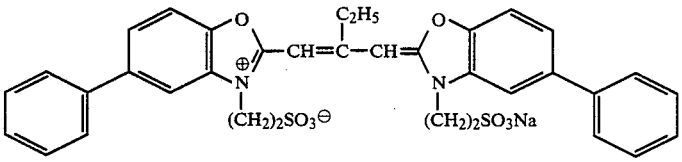
ExS-8
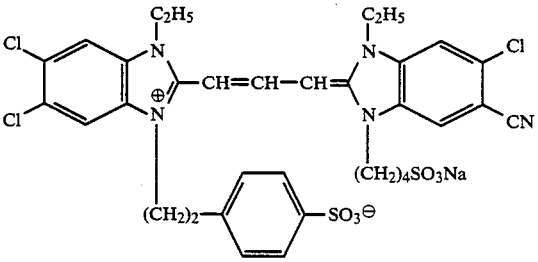
ExS-9
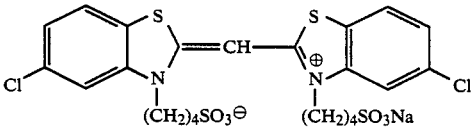
H-1
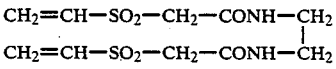
Cpd-3
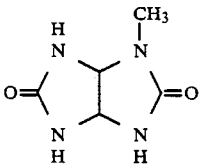
Cpd-4
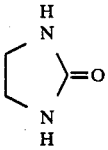
Sample 102
Sample 102 was prepared by adding 1.71 g of compound (I-1) in 2 ml of methanol to each layer of sample 101 per Kg of gelatin in each layer of Sample 101. Compound (I-1) was coated in an amount of 20 mg/m$^2$.

Sample 103 to 109

Samples 103 to 109 were prepared by adding the compound of the present invention to each layer in an amount shown in table 1 in the same manner as with Sample 102.

The thus prepared color photographic light-sensitive materials were exposed, then subjected to the following processing steps.

TABLE 1

| Step | Processing Time | Processing Temp. |
|---|---|---|
| Color development | 3 min and 15 sec | 38° C. |
| Bleaching | 6 min and 30 sec | 38° C. |
| Washing with water | 2 min and 10 sec | 24° C. |
| Fixing | 4 min and 20 sec | 38° C. |
| Washing with water (1) | 1 min and 05 sec | 24° C. |
| Washing with water (2) | 1 min and 00 sec | 24° C. |
| Stabilizing | 1 min and 05 sec | 38° C. |
| Drying | 4 min and 20 sec | 55° C. |

Formulations of the processing solutions used are shown below.

| | (unit: g) |
|---|---|
| Color developer | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxyethylamino)-2-methylaniline sulfate | 4.5 |
| Water to make | 1.0 liter |
| pH | 10.05 |
| Bleaching solution | |
| Sodium ethylenediaminetetra-acetato ferrate trihydrate | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water to make | 1.0 liter |
| pH | 6.0 |
| Fixing solution | |
| Disodium ethylenediaminetetraacetate | 0.5 |
| Sodium sulfite | 7.0 |
| Ammonium thiosulfate aqueous solution (70%) | 170.0 ml |
| Water to make | 1.0 liter |
| pH | 6.7 |
| Stabilizing solution | |
| Formalin (37%) | 2.0 ml |
| Polyoxyethylene-p-monononylphenyl ether (average polymerization degree: 10) | 0.3 |
| Disodium ethylenediaminetetraacetate | 0.05 |
| Water to make | 1.0 liter |

-continued

| | (unit: g) |
|---|---|
| pH | 5.0-8.0 |

Results of tests for antifungal and antibacterial properties of these samples are tabulated in Table 1.

TABLE 1

| Sample | Amount of Added Compound mg/m² | | | | | Antifungal Properties | | | Antibacterial Properties | |
|---|---|---|---|---|---|---|---|---|---|---|
| | I-1 | II-1 | II-9 | II-11 | III-25 | 10 days | 20 days | 30 days | 24 hr | 48 hr |
| 101(Comparison) | — | — | — | — | — | 4 | 4 | 4 | 2 | 2 |
| 102(Comparison) | 20 | — | — | — | — | 1 | 1 | 2 | 2 | 2 |
| 103(Comparison) | — | 100 | — | — | — | 2 | 3 | 4 | 1 | 2 |
| 104(Comparison) | — | — | — | — | 10 | 1 | 2 | 3 | 1 | 1 |
| 105(Invention) | 5 | 50 | — | — | — | 0 | 0 | 1 | 0 | 1 |
| 106(Invention) | 5 | — | — | — | 5 | 0 | 0 | 0 | 0 | 0 |
| 107(Invention) | 5 | 10 | — | — | 2.5 | 0 | 0 | 0 | 0 | 0 |
| 108(Invention) | 5 | — | 10 | — | — | 0 | 0 | 1 | 0 | 0 |
| 109(Invention) | 5 | — | — | 5 | — | 0 | 0 | 1 | 0 | 0 |

TABLE 2

Criteria for Rating Antifungal Properties

| Growth of Hypha | Rating of Antifungal Properties |
|---|---|
| No growth of hypha is observed. | 0 |
| Slight growth of hypha is observed. | 1 |
| Hypha-growing area is not more than ⅓ of the total surface area. | 2 |
| Hypha-growing area is more than ⅓ of the total surface area. | 3 |
| Hypha-growing area is 90% or more of the total surface area. | 4 |

TABLE 3

Criteria for Rating Antibacterial Properties

| Growth of Colony | Rating of Antibacterial properties |
|---|---|
| No colonies are observed in sample. | 0 |
| Colonies are slightly observed in sample. | 1 |
| A number of colonies are observed in sample. | 2 |

The tests were conducted as follows.

Of the thus prepared samples, unexposed Samples 101 to 109 were subjected to the testing for antifungal properties. Fungi having grown in color negatives were cultured in potato-dextrose agar medium, and spores were collected to prepare a spore-suspended solution containing about $1\times10^6$ spores/ml. 0.5 ml of this spore-suspended solution was dropped onto each sample, then the sample was kept at 28° C. and 95% humidity to observe the growing state of fungi. Results of the observation are shown in Table 1. Rating criteria are given in Table 2.

Anitbacterial properties were rated according to Table 3, after leaving the samples for 24 hours or 48 hours at 40° C. and culturing at 40° C. for 24 hours using EAGICULT TTC bacteria-testing plates made by ORION DIAGNOSTICA CO.

It is seen from the results that samples 105 to 109 were clearly better than samples 102 to 104 in antifungal and antibacterial properties.

EXAMPLE 2

Multi-layer photographic printing paper as Sample 201 composed of a polyethylene-double laminated paper support having provided thereon the following layer structure was prepared. Coating solution were prepared as follows.

27.2 cc of ethyl acetate and 7.7 cc (8.0 g) of a high-boiling point solvent (Solv-1) were added to a mixture of 10.2 g of yellow coupler (ExY-1), 9.1 g of yellow coupler (ExY-2) and 4.4 g of color image stabilizer (Cpd-2) to prepare a solution. This solution was emulsified and dispersed in 185 cc of a 10% gelatin aqueous solution containing 8 cc of 10% sodium dodecylbenzenesulfonate. This emulsion dispersion was mixed with emulsion EM1 and EM2 to adjust the gelatin concentration to the following formulation, to prepare a coating solution for a first layer. Coating solution for forming second to seventh layers were also prepared in the same manner as the coating solution for forming a first layer. As a gelatin hardener for each layer, 2,4-dichloro-6-hydroxy-s-triazine sodium salt was used.

In addition, (Cpd-1) was used as a thickening agent for the coating solutions.

Layer Structure

The compositions of the respective layers are shown below, coated amounts being shown as (g/m$^2$), and amounts of coated silver emulsions being shown as silver amounts.

| Support | |
|---|---|
| Polyethylene-laminated paper (containing a white pigment ($TiO_2$) and a bluish dye in polyethylene on the side of first layer) | |
| First layer (Blue-sensitive layer) | |
| Monodispersed AgClBr emulsion (EM1) spectrally sensitized with sensitizing dye (ExS-1) | 0.13 |
| Monodispersed AgClBr emulsion (EM2) spectrally sensitized with sensitizing dye (ExS-1) | 0.13 |
| Gelatin | 1.86 |
| Yellow coupler (ExY-1) | 0.44 |
| Yellow coupler (ExY-2) | 0.39 |
| Color image-stabilizing agent (Cpd-2) | 0.19 |
| Solvent (Solv-1) | 0.35 |
| Dispersing polymer (Cpd-12) | 0.21 |
| Color image-stabilizing agent (Cpd-19) | 0.01 |
| Second layer (Color mixing-preventing layer) | |
| Gelatin | 0.99 |
| Color mixing-preventing agent (Cpd-3) | 0.08 |
| Third layer (Green-sensitive layer) | |
| Monodispersed AgClBr emulsion (EM3) spectrally sensitized with sensitizing dye (ExS-2,3)(1:1 mol ratio) | 0.05 |
| Monodispersed AgClBr emulsion (EM4) spectrally sensitized with sensitizing dye (ExS-2,3)(1:1 mol ratio) | 0.11 |
| Gelatin | 1.80 |
| Magenta coupler (ExM-1) | 0.39 |
| Color image-stabilizing agent (Cpd-4) | 0.20 |
| Color image-stabilizing agent (Cpd-5) | 0.02 |
| Color image-stabilizing agent (Cpd-6) | 0.03 |
| Solvent (Solv-2) | 0.12 |
| Solvent (Solv-3) | 0.25 |
| Fourth layer (UV ray absorbing layer) | |
| Gelatin | 1.60 |
| UV ray absorbents (Cpd-7/Cpd-9/Cpd-17 = 3/2/6 by weight) | 0.70 |
| Color mixing-preventing agent (Cpd-11) | 0.05 |
| Solvent (Solv-4) | 0.27 |
| Fifth layer (Red-sensitive layer) | |
| Monodispersed AgClBr emulsion (EM5) spectrally sensitized with sensitizing dyes (ExS-4,5)(1:1 mol ratio) | 0.07 |
| Monodispersed AgClBr emulsion (EM6) spectrally sensitized with sensitizing dyes (ExS-4,5)(1:1 mol ratio) | 0.16 |
| Gelatin | 0.92 |
| Cyan coupler (ExC-1) | 0.16 |
| Cyan coupler (ExC-2) | 0.16 |
| Color image-stabilizing agents (Cpd-8/Cpd-9/Cpd-10 = 3/4/2 by weight) | 0.17 |
| Dispersing polymer (Cpd-12) | 0.28 |
| Solvent (Solv-2) | 0.15 |
| Solvent (Solv-5) | 0.10 |
| Color image-stabilizing agent (Cpd-19) | 0.02 |
| Sixth layer (UV ray-absorbing layer) | |
| Gelatin | 0.54 |
| UV ray absorbents (Cpd-7/Cpd-8/Cpd-9 = 1/5/3 by weight) | 0.21 |
| Solvent (Solv-5) | 0.08 |
| Seventh layer (Protective layer) | |
| Acid-processed gelatin | 1.33 |
| Acryl-modified polyvinyl alcohol copolymer (modification degree: 17%) | 0.17 |
| Liquid paraffin | 0.03 |

In this preparation, (Cpd-13) and (Cpd-14) were used as irradiation-preventing dyes.

Further, Alkanol XC (made by Du Pont de Nermous & Co.), sodium alkyl-benzenesulfonate, succinate, and MagefacX F-120 (made by Dai Nippon Ink & Chemicals, Inc.) were used as emulsifying and dispersing agents or coating aids. (Cpd-15, 16, 18) were used as stabilizers for silver halide.

ExS-1

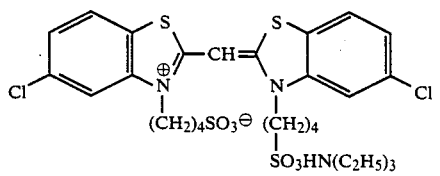

-continued
ExS-2
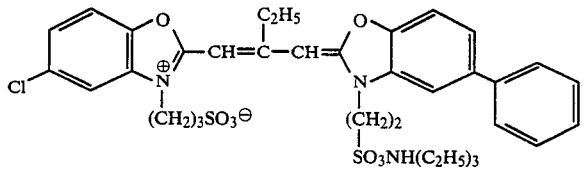
ExS-3
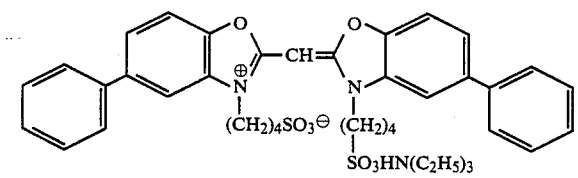
ExS-4
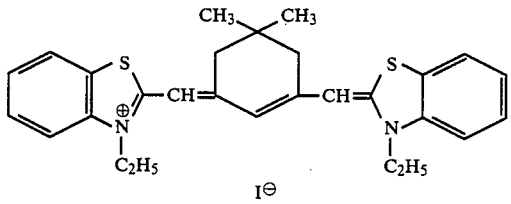
ExS-5
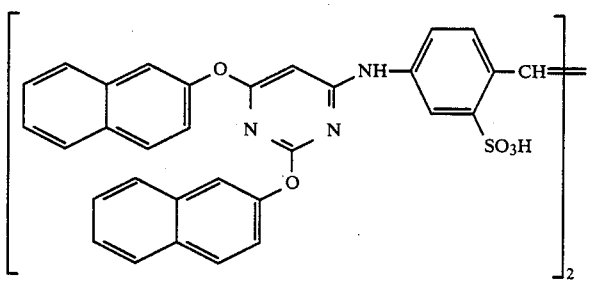
ExY-1
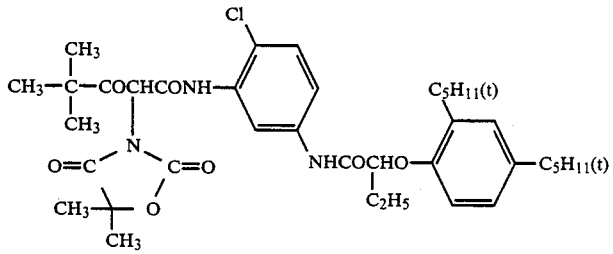
ExY-2
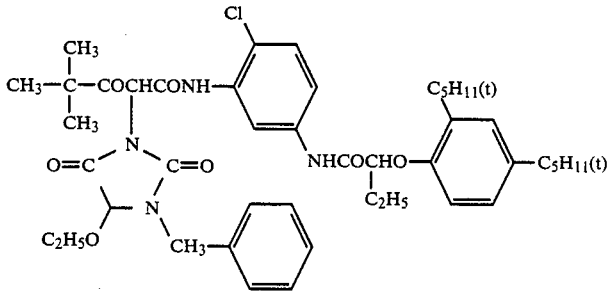

-continued
ExM-1
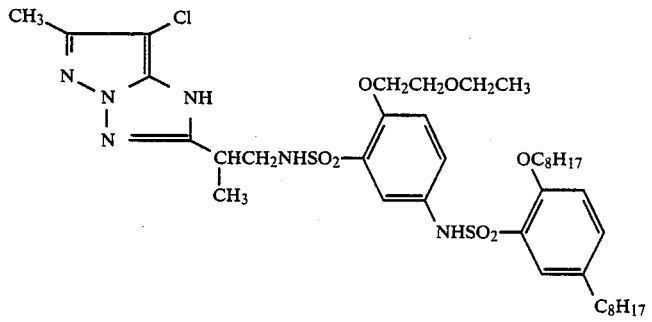
ExC-1
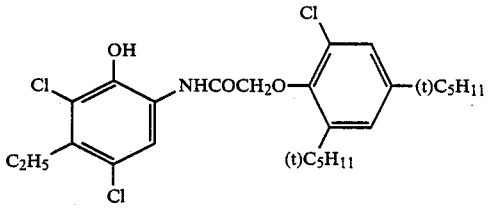
ExC-2
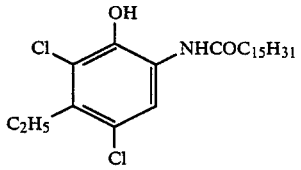
Cpd-1
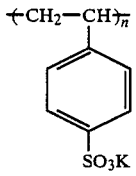
Cpd-2
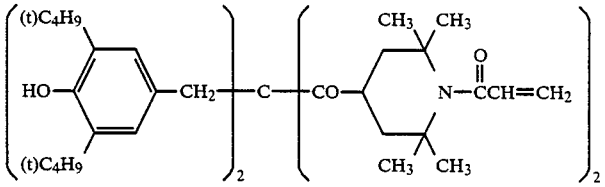
Cpd-3
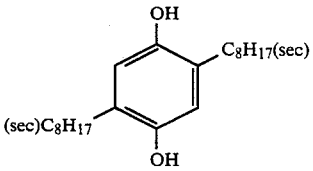
Cpd-4
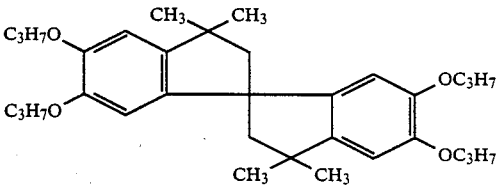

-continued
Cpd-5
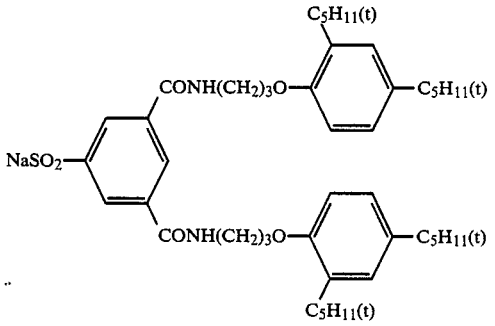
Cpd-6
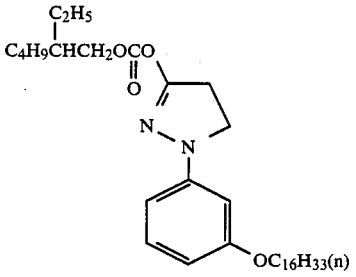
Cpd-7
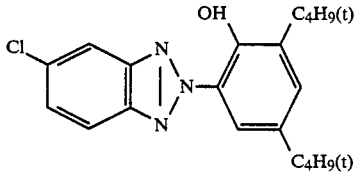
Cpd-8
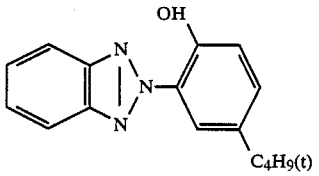
Cpd-9
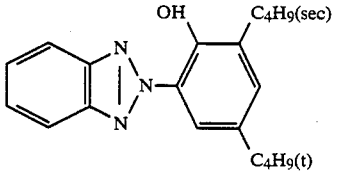
Cpd-10
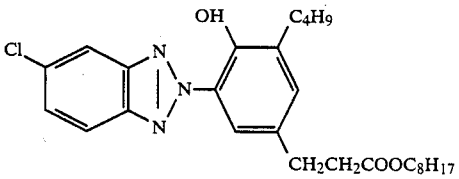
Cpd-11
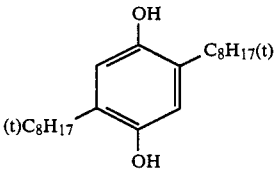
Cpd-12
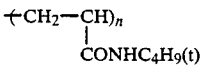
mol. wt. ca. 60,000

-continued

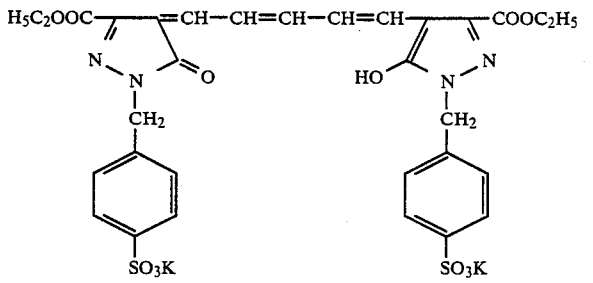

Cpd-13

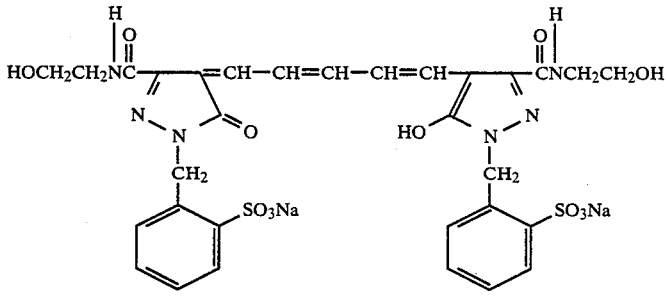

Cpd-14

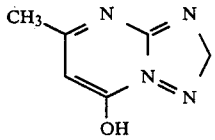

Cpd-15

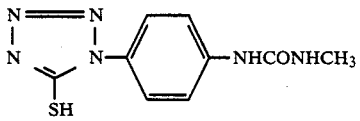

Cpd-16

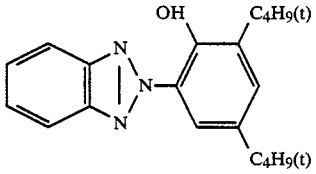

Cpd-17

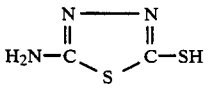

Cpd-18

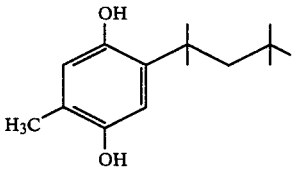

Cpd-19

Solv-1: Dibutyl phthalate
Solv-2: Tricresyl phosphate
Solv-3: Trioctyl phosphate
Solv-4: Trinonyl phosphate
Solv-5: Dioctyl sebacate

| Name of Emulsion | Grain Form | Average Grain Diameter*1 (μ) | Br Content (mol %) | Variation Coefficient*2 |
|---|---|---|---|---|
| EM1 | Cube | 1.0 | 80 | 0.08 |
| EM2 | Cube | 0.75 | 80 | 0.07 |
| EM3 | Cube | 0.5 | 83 | 0.09 |
| EM4 | Cube | 0.4 | 83 | 0.10 |

-continued

| Name of Emulsion | Grain Form | Average Grain Diameter*1 (μ) | Br Content (mol %) | Variation Coefficient*2 |
|---|---|---|---|---|
| EM5 | Cube | 0.5 | 73 | 0.09 |

-continued

| Name of Emulsion | Grain Form | Average Grain Diameter*1 (μ) | Br Content (mol %) | Variation Coefficient*2 |
|---|---|---|---|---|
| EM6 | Cube | 0.4 | 73 | 0.10 |

*1 Average of projected edge length
*2 Presented in terms of the ratio of standard deviation (S) to average diameter ($\bar{d}$) (namely, $S/\bar{d}$).

Samples 202 to 207 were prepared by adding independently or in combination the following compounds as shown below to Sample 201 according to the process described in Example 1:

Sample 201: none
Sample 202: compound (I-1)
Sample 203: compound (II-1)
Sample 204: compound (III-25)
Sample 205: compound (I-1)+compound (II-1)
Sample 206: compound (I-1)+compound (III-25)
Sample 207: compound (I-1)+compound (II-1)+compound (III-25)

The thus prepared Samples 201 to 207 were exposed and subjected to the following development processing. The processed samples were subjected to evaluation of antifungal properties according to the rating method shown in Table 2. Antibacterial properties were also rated in the same manner as in Example 1. Results thus obtained are shown in Table 4.

TABLE 4

Results of rating of anti-fungal and anti-bacterial properties (II)

| Sample | Amount of Added Compound (mg/m²) I-1 | II-1 | III-25 | Anti-fungal Properties 10 days | 20 days | 30 days | Anti-bacterial Properties 24 hrs | 48 hrs | Remarks |
|---|---|---|---|---|---|---|---|---|---|
| 201 | — | — | — | 4 | 4 | 4 | 2 | 2 | Comparison |
| 202 | 10 | — | — | 1 | 1 | 2 | 2 | 2 | " |
| 203 | — | 50 | — | 2 | 3 | 4 | 1 | 2 | " |
| 204 | — | — | 10 | 1 | 2 | 3 | 1 | 1 | " |
| 205 | 2.5 | 25 | — | 0 | 0 | 1 | 0 | 1 | Invention |
| 206 | 2.5 | — | 2.5 | 0 | 0 | 0 | 0 | 0 | " |
| 207 | 1.3 | 5 | 1.3 | 0 | 0 | 0 | 0 | 0 | " |

It is seen that Samples 205 to 207 exhibited show extremely higher antifungal and anti-bacterial properties than Samples 201 to 204.

| Processing step | Temperature | Time |
|---|---|---|
| Color development | 38° C. | 1 min & 40 sec |
| Bleach-fixing | 30–34° C. | 1 min & 00 sec |
| Washing with water (1) | 30–34° C. | 20 sec |
| Washing with water (2) | 30–34° C. | 20 sec |
| Washing with water (3) | 30–34° C. | 20 sec |
| Drying | 70–80° C. | 50 sec |

(Water-washing steps were conducted in a 3-tank counter current manner of water washing (3)→(1).)

The formulations of respective processing solutions are as shown below.

| Color developer | |
|---|---|
| Water 800 | ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| 1,3-Diamino-2-propanol | 4.0 g |
| Triethylenediamine(1,4-diazabicyclo-(2,2,2)octane) | 6.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Hydroxylamine sulfate | 4.0 g |
| Fluorescent brightening agent (UVITEX-CK, MADE BY CIBA GEIGY) | 1.5 g |
| Water to make | 1000 ml |
| pH (25° C.) | 10.25 |
| Bleach-fixing solution | |
| Water | 400 ml |
| Ammonium thiosulfate (70%) | 100 ml |
| Sodium sulfite | 20 g |
| Ammonium ethylenediamine-tetraacetato ferrate | 60 g |
| Disodium ethylenediaminetetraacetate | 10 g |
| Water to make | 1000 ml |
| pH (25° C.) | 7.00 |

Water for Washing

Tap water was passed through a mixed bed-type column filled with an H-type strongly acidic cation-exchange resin (Amberlite IR-120B; made by Rohm & Haas Co.) and an OH-type strongly basic anion-exchange resin (Amberlite IRA-400; made by Rohm & Haas Co.) to thereby reduce calcium and magnesium ion concentrations to 3 mg/liter or less, followed by adding to the thus-processed water 20 mg/liter of sodium dichloroisocyanurate and 150 mg/liter of sodium sulfate. This solution had a pH of between 6.5 and 7.5.

EXAMPLE 3

(1) Preparation of Light-Sensitive Silver Halide Emulsions

Potassium bromide and potassium iodide, and silver nitrate were added to a gelatin aqueous solution under vigorous stirring to prepare silver iodobromide (AgI=4 mol %) of thick tabular form having an average grain size of 1 μ. This was then washed with water according to a conventional precipitation process, and was subjected to chemical sensitization according to gold-sulfuric acid sensitization using chloroauric acid and sodium thiosulfate to obtain light-sensitive silver iodobromide emulsion A. Silver halide emulsions B (0.8 μ in average grain size) and C (0.6 μ in average grain size) were prepared in the same manner as silver halide emulsion A except for controlling temperature upon preparation.

(2) Preparation of Coated Sample

Sample 301 was prepared on a triacetyl cellulose support by providing in sequence layers of the following formulations from the support side. As the support, a support of 0.3 in optical density was used.

| | | |
|---|---|---|
| First emulsion layer | | |
| Silver halide emulsion C | | 1.8 g/m² of Ag |
| Binder: gelatin | | 1.6 g/g Ag |
| Sensitizing dye: | | 2.1 mg/g Ag |

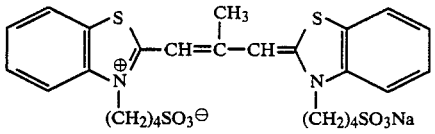

| | | |
|---|---|---|
| Coating aid: | sodium dodecylbenzene-sulfonate | 0.1 mg/m² |
| | potassium poly-p-styrene-sulfonate | 1 mg/m² |
| Second emulsion layer | | |
| Silver halide emulsion A | | 1.8 g/m² of Ag |
| Silver halide emulsion B | | 1.8 g/m² of Ag |
| Binder: gelatin | | 1.6 g/g Ag |
| Sensitizing Dye: | | 2.1 mg/g Ag |

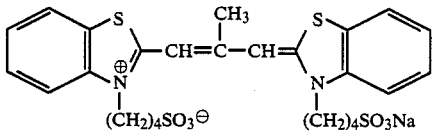

| | | |
|---|---|---|
| Coating aid: | sodium dodecylbenzene-sulfonate | 0.1 mg/m² |
| | potassium poly-p-styrene-sulfonate | 1 mg/m² |
| Surface-protective layer | | |
| Binder: gelatin | | 0.7 g/m² |
| Coating aid: Sodium N-oleoyl-N-methyl-taurinate | | 0.2 mg/m² |

Samples 302 to 307 were prepared by adding independently or in combination the following compounds to Sample 301 according to the process described in Example 1.

Sample 301: none
Sample 302: compound (I-1)
Sample 303: compound (II-1)
Sample 304: compound (III-25)
Sample 305: compound (I-1)+(II-1)
Sample 306: compound (I-1)+compound (III-25)
Sample 307: compound (I-1)+compound (II-1)+compound (III-25)

Anti-fungal and anti-bacterial properties of these samples were rated. The rating method was the same as in Example 1. The results thus obtained are tabulated in Table 5.

TABLE 5

| | Results of rating of anti-fungal and anti-bacterial properties | | | | | | | | |
|---|---|---|---|---|---|---|---|---|---|
| | Amount of Added Compound (mg/m²) | | | Anti-fungal Properties | | | Anti-bacterial Properties | | |
| Sample | I-1 | II-1 | III-25 | 10 days | 20 days | 30 days | 24 hrs | 48 hrs | Remarks |
| 301 | — | — | — | 4 | 4 | 4 | 2 | 2 | Comparison |
| 302 | 20 | — | — | 1 | 1 | 2 | 2 | 2 | " |
| 303 | — | 100 | — | 2 | 3 | 4 | 1 | 2 | " |
| 304 | — | — | 10 | 1 | 2 | 3 | 1 | 1 | " |
| 305 | 5 | 50 | — | 0 | 0 | 0 | 0 | 0 | Invention |
| 306 | 5 | — | 5 | 0 | 0 | 0 | 0 | 0 | " |
| 307 | 2.5 | 10 | 5 | 0 | 0 | 0 | 0 | 0 | " |

The above-described samples were developed in a developer of the following formulation at 20° C. for 7 minutes, then fixed, washed with water and dried.

| Developer | |
|---|---|
| Metol | 2 g |
| Sodium sulfite | 100 g |
| Hydroquinone | 5 g |
| Borax.$10H_2O$ | 2 g |
| Water to make | 1 liter |
| Fixing solution | |
| Ammonium thiosulfate | 240.0 g |
| Sodium sulfite (anhydrous) | 15.0 g |
| Acetic acid (28%) | 48 ml |
| Sodium metaborate | 15 g |
| Potash alum | 15 g |
| Water to make | 1.0 liter |

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereof at least one light-sensitive silver halide emulsion layer, wherein said material contains the combination of (i) at least one compound represented by formula (I) added to a protective layer and (ii) at least one compound represented by formulae (II) and/or (III) added to a protective layer, an interlayer, a filter layer or an antihalation layer

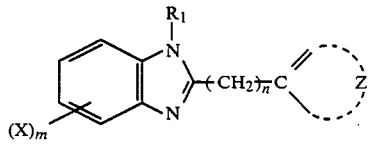

(I)

wherein $R_1$ represents hydrogen, a substituted or unsubstituted alkyl group, a substituted or unsubstituted aryl group or a substituted or unsubstituted aralkyl group; X represents a halogen atom, a nitro group, a hydroxyl group, a cyano group, a lower alkyl group, a lower alkoxy group, —$COR_2$,

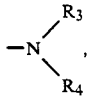

or —$SO_3M$; $R_2$ represents hydrogen, —OM, a lower alkyl group, an aryl group, an aralkyl group, a lower alkoxy group, an aryloxy group, an aralkyloxy group or

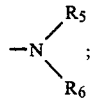

$R_3$ and $R_4$, which may be the same or different, each represents hydrogen, a lower alkyl group, an aryl group, an aralkyl group, $—COR_7$ or $—SO_2R_7$; $R_5$ and $R_6$, which may be the same or different, each represents hydrogen, a lower alkyl group, an aryl group or an aralkyl group; $R_7$ represents a lower alkyl group, an aryl group or an aralkyl group; M represents hydrogen, an alkali metal atom or a monovalent cation; m represents 0 or an integer of 1 to 4, n represents 0 or an integer of 1 to 4, and Z represents an atomic group necessary for forming a thiazolyl ring (II)

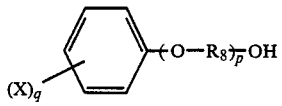

wherein $R_8$ represents a lower alkylene group, X is the same as defined for X in formula (I); p represents 0 or 1, and q represents 0 or an integer of 1 to 5; and (III)

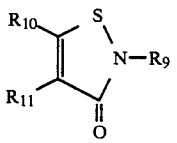

wherein $R_9$ represents hydrogen, a substituted or unsubstituted alkyl group, a substituted or unsubstituted alkenyl group, a substituted or unsubstituted aralkyl group, a substituted or unsubstituted aryl group, a heterocyclic group,

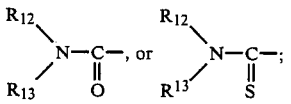

$R_{10}$ and $R_{11}$ each represents hydrogen, a substituted or unsubstituted alkyl group, a substituted or unsubstituted aryl group, a cyano group, a heterocyclic group, a substituted or unsubstituted alkylthio group, a substituted or unsubstituted arylthio group, a substituted or unsubstituted alkylsulfonyloxy group or a substituted or unsubstituted alkylsulfonyl group; $R_{10}$ and $R_{11}$ may be linked to form an aromatic ring; and $R_{12}$ and $R_{13}$, which may be the same or different, each represents hydrogen, a substituted or unsubstituted alkyl group, a substituted or unsubstituted aryl group or a substituted or unsubstituted aralkyl group.

2. The silver halide photographic material as claimed in claim 1, wherein in formula (I) $R_1$ represents hydrogen; X represents hydrogen, an alkyl group containing 1 to 3 carbon atoms, an amino group, a nitro group, a sulfo group, a halogen atom or a hydroxyl group; m is 1 or 2; n is 0; and said thiazole ring formed by Z is a 5-thiazolyl group.

3. The silver halide photographic material as claimed in claim 1, wherein in formula (II) X represents a lower alkyl group, an alkoxycarbonyl group or a halogen atom.

4. The silver halide photographic material as claimed in claim 1, wherein in formula (III) $R_9$ represents hydrogen, an alkyl group, and $R_{10}$ and $R_{11}$ each represents hydrogen, an alkyl group, an aryl group, and a cyano group.

5. The silver halide photographic material as claimed in claim 1, wherein said compound represented by formula (I) is the following compound:

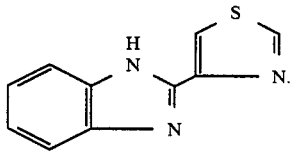

6. The silver halide photographic material as claimed in claim 5, wherein said compound represented by formula (II) is phenol.

7. The silver halide photographic material as claimed in claim 5, wherein said compound represented by formula (II) is the following compound:

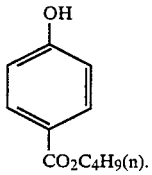

8. The silver halide photographic material as claimed in claim 5, wherein said compound represented by formula (II) is the following compound:

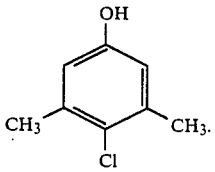

* * * * *